US006064367A

United States Patent [19]

Horioka

[11] Patent Number: 6,064,367

[45] Date of Patent: May 16, 2000

[54] BIT EXPANDER

[75] Inventor: Toshio Horioka, Kanagawa, Japan

[73] Assignee: Sony Corporation, Japan

[21] Appl. No.: 09/064,663

[22] Filed: Apr. 23, 1998

[30] Foreign Application Priority Data

May 6, 1997 [JP] Japan ..... 9-115858

[51] Int. Cl.[7] ..... G09G 5/04

[52] U.S. Cl. ..... 345/155; 345/153; 345/154

[58] Field of Search ..... 345/155, 153, 345/509, 202, 203, 154; 341/50–55; 364/716.05, 748.05; 370/514

[56] References Cited

U.S. PATENT DOCUMENTS 5,469,190 11/1995 Masterson ..... 345/155
5,506,604 4/1996 Nally et al. ..... 345/154
5,907,370 5/1999 Suzuki et al. ..... 348/607

FOREIGN PATENT DOCUMENTS 3-210593 9/1991 Japan ..... G09G 5/00

*Primary Examiner*—Lun-yi Lao
*Assistant Examiner*—Jimmy Hai Nguyen
*Attorney, Agent, or Firm*—Rader, Fishman & Grauer; Ronald P. Kananen

[57] ABSTRACT

N expansion bits are added to the LSB side of original data of m bits and thereby expanded data of (m+n) bits is obtained. In the case of m≦n, each bit of original data of m bits is repeatedly assigned to the LSB side of original data. In the case of m>n, n bits on the MSB side of the original data of m bits are added to the LSB side of original data. Since the bit values of expansion bits vary corresponding to the values of the original data, a bit expansion can be smoothly performed in the full range.

4 Claims, 5 Drawing Sheets

Fig. 4

| ORIGINAL | EXPANSION | (DECIMAL) |
|---|---|---|
| MSB | | |
| 00000. | 000 | 0 |
| 00001. | 000 | 1 |
| 00010. | 000 | 2 |
| 00011. | 000 | 3 |
| 00100. | 001 | 4. 125 |
| 00101. | 001 | 5. 125 |
| 00110. | 001 | 6. 125 |
| 00111. | 001 | 7. 125 |
| 01000. | 010 | 8. 25 |
| 01001. | 010 | 9. 25 |
| 01010. | 010 | 10. 25 |
| 01011. | 010 | 11. 25 |
| 01100. | 011 | 12. 375 |
| 01101. | 011 | 13. 375 |
| 01110. | 011 | 14. 375 |
| 01111. | 011 | 15. 375 |
| 10000. | 100 | 16. 5 |
| 10001. | 100 | 17. 5 |
| 10010. | 100 | 18. 5 |
| 10011. | 100 | 19. 5 |
| 10100. | 101 | 20. 625 |
| 10101. | 101 | 21. 625 |
| 10110. | 101 | 22. 625 |
| 10111. | 101 | 23. 625 |
| 11000. | 110 | 24. 75 |
| 11001. | 110 | 25. 75 |
| 11010. | 110 | 26. 75 |
| 11011. | 110 | 27. 75 |
| 11100. | 111 | 28. 825 |
| 11101. | 111 | 29. 825 |
| 11110. | 111 | 30. 825 |
| 11111. | 111 | 31. 825 |

BIT EXPANDER

BACKGROUND OF THE INVENTION

1. Field of the Invention

The present invention relates to a bit expander that is suitable for graphics data and that allows bits of digital data to be smoothly expanded.

2. Description of the Related Art

In computers and home-use video game apparatuses, so-called full-color graphic data has a data width of 24 bits where eight bits are assigned to each of R (red), G (Green), and B (Blue). Thus, since each of primary colors is represented with 256 tones, a total of around 16,770,000 colors can be represented.

However, actually, due to a restriction of a memory space or the like, graphics data is occasionally handled as data of 16 bits. For example, five bits, six bits, and five bits are assigned to R (Red), G (Green), and B (Blue), respectively. Graphics data of 16 bits is stored to for example a storage medium. Various picture processes are performed for graphics data read from a storage medium and the resultant data is displayed on a screen.

When graphics data of 16 bits is processed, there are situations of which the graphics data should be handled as data of 24 bits. For example, when the data width of an internal bus is eight bits, each of primary colors R, G, and B should be handled as data of eight bits. In another situation, three primary colors R, G, and B are processed as data of five bits, data of six bits, and data of five bits, respectively, and each of them are displayed as data of eight bits.

In such situations, the data width of each of the three primary colors R, G, and B should be expanded from five bits (or six bits) to eight bits. In a related art reference, a bit expansion is performed with fixed values. In other words, all "1s" or all "0s" are added to the low order side of original data. FIGS. 1A and 1B shows bit expansions with such fixed values. N "1s" (see FIG. 1A) or n "0s" (see FIG. 1B) are added to the low order side of data of m bits and thereby data of (m+n) bits is obtained. In this method, with a very simple circuit, bits can be expanded. In reality, expansion bits are placed below a decimal point.

FIG. 2 shows an example of the result of a bit expansion according to the related art reference. In FIG. 2, a value 255.255/256 on the vertical axis represents 255+(255/256). In this example, it is assumed that m=n =8 (bits). In the method shown in FIG. 1A, when n "1s" are used as expansion bits, as denoted by a line A shown in FIG. 2, an offset of 255/256 is added to the original value. On the other hand, in the method shown in FIG. 1B, the expanded result is the same as the original value (as denoted by a line B in FIG. 2).

Now, consider the case of which such a bit expansion is applied to graphics data. When graphics data is expanded as denoted by the line A and the resultant data is displayed, the black level is raised. Likewise, when graphics data is expanded as denoted by the line B and the resultant data is displayed, the maximum level of the white level is slightly lowered. Thus, the black level or white level deviates at both edges thereof or in the vicinity thereof. The user easily becomes aware of such deviations. In other words, ideally, a bit expansion should be performed smoothly in the full range as denoted by a line C in FIG. 2.

Thus, in the bit expanding method of the related art reference, data (in particular, graphics data) cannot be smoothly displayed in the full range.

OBJECTS AND SUMMARY OF THE INVENTION

Therefore, an object of the present invention is to provide a bit expander that allows bits to be smoothly expanded in the full range and that is structured with a simple circuit.

The present invention is a bit expander for adding n expansion bits to original data of m bits and expanding the original data of m bits to data of (m+n) bits, wherein a predetermined number of bits on the MSB side of the original data of m bits are added to the low order side of the original data.

Thus, according to the present invention, since a predetermined number of high order bits of original data are added to the low order side of the original data, a bit expansion can be performed in a simple structure.

These and other objects, features and advantages of the present invention will become more apparent in light of the following detailed description of a best mode embodiment thereof, as illustrated in the accompanying drawings.

BRIEF DESCRIPTION OF THE DRAWINGS

FIG. 4 is a list showing a practical example of a bit expansion in the case that m=5 and n=3;

DETAILED DESCRIPTION OF THE PREFERRED EMBODIMENTS

Next, an embodiment of the present invention will be described. According to the present invention, when data of m bits as original data is expanded by n bits to data of (m+n) bits, a predetermined number of bits on the MSB side of the original data are assigned to the low order side of the original data as n expansion bits. The expansion bits are assigned corresponding to the relation of m and n.

Figure 3A:
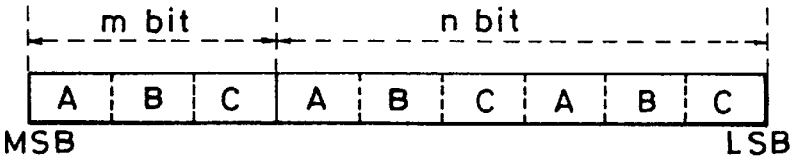
FIGS. 3A and 3B are schematic diagrams showing examples of assignments of expansion bits according to an embodiment of the present invention.
Figure 3B:
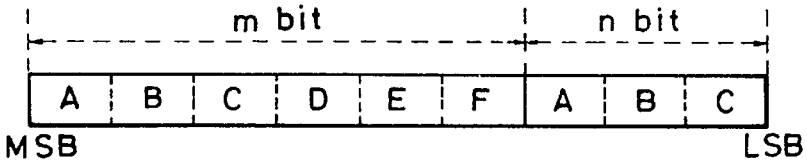

FIGS. 3A and 3B show examples of assignments of expansion bits according to an embodiment of the present invention. FIG. 3A shows an example of an assignment of a bit expansion in the case that $m \leqq n$. In this case, as shown in FIG. 3A, each bit of original data of m bit is repeatedly assigned as n expansion bits. In this example, where m=3 and n=6, original data of three bits ("ABC") is repeatedly assigned as expansion bits as in "ABCABC". The expanded data is composed of nine bits as in "ABC.ABCABC".

Even if the relation of m and n is not an integer as in the case that m=3 and n=5, a bit expansion can be performed in the above-described manner. In other words, original data of m bits are placed from the MSB side at bit positions corresponding to remaining bits of which n expansion bits are divided by m.

FIG. 3B shows an example of an assignment of expansion bits in the case that m>n. In this case, as shown in FIG. 3B, high order n bits on the MSB side of m bits are assigned as assignment bits. In this example, where m=6 and n=3, n bits ("ABC") on the MSB side of original data ("ABCDEF") of six bits are assigned as n expansion bits. The resultant expanded data of nine bits is "ABCDEF.ABC".

FIG. 4 shows a practical example in the case that m=5 and n=3 (namely, expansion data of three bits is added to original data of five bits and thereby expanded data of eight bits is obtained). This example is equivalent to the case that R (Red) of five bits and B (Blue) of five bits of graphics data are expanded to data of eight bits, each. Three bits on the MSB side of original data are added to the low order side of original data as expansion bits.

Figure 1A:
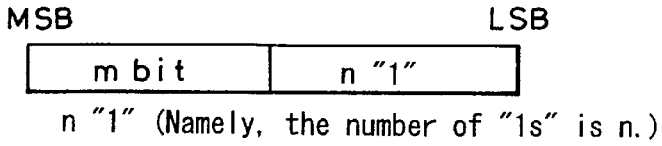
Fig. 1A PRIOR ART
FIGS. 1A and 1B are schematic diagrams showing examples of bit expansions with fixed values.
Figure 1B:
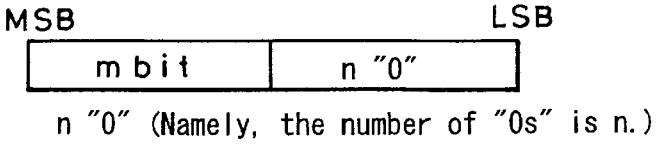
Fig. 1B PRIOR ART
Figure 2:
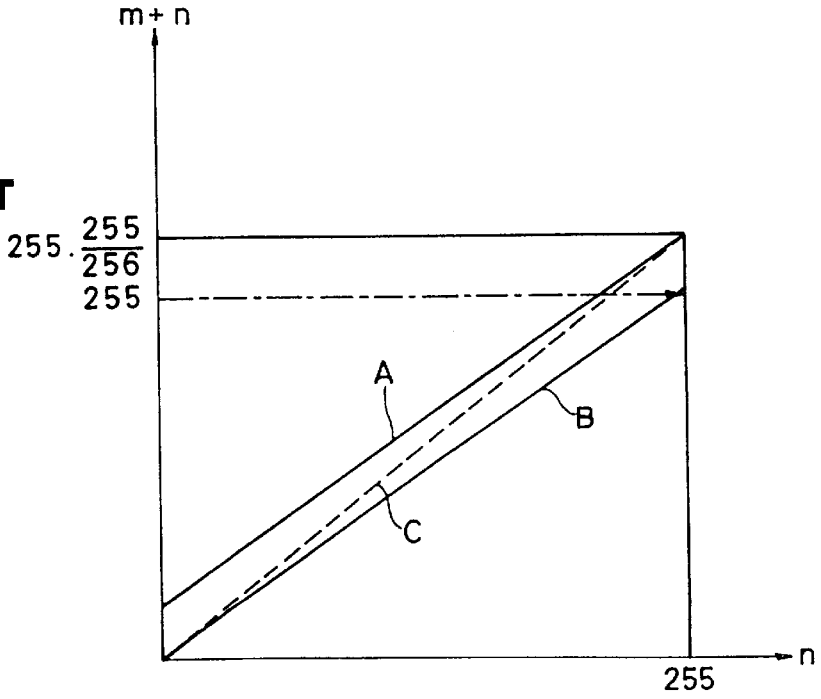
Fig. 2 PRIOR ART
FIG. 2 is a graph showing an example of the result of a bit expansion according to a related art reference.
Figure 5:
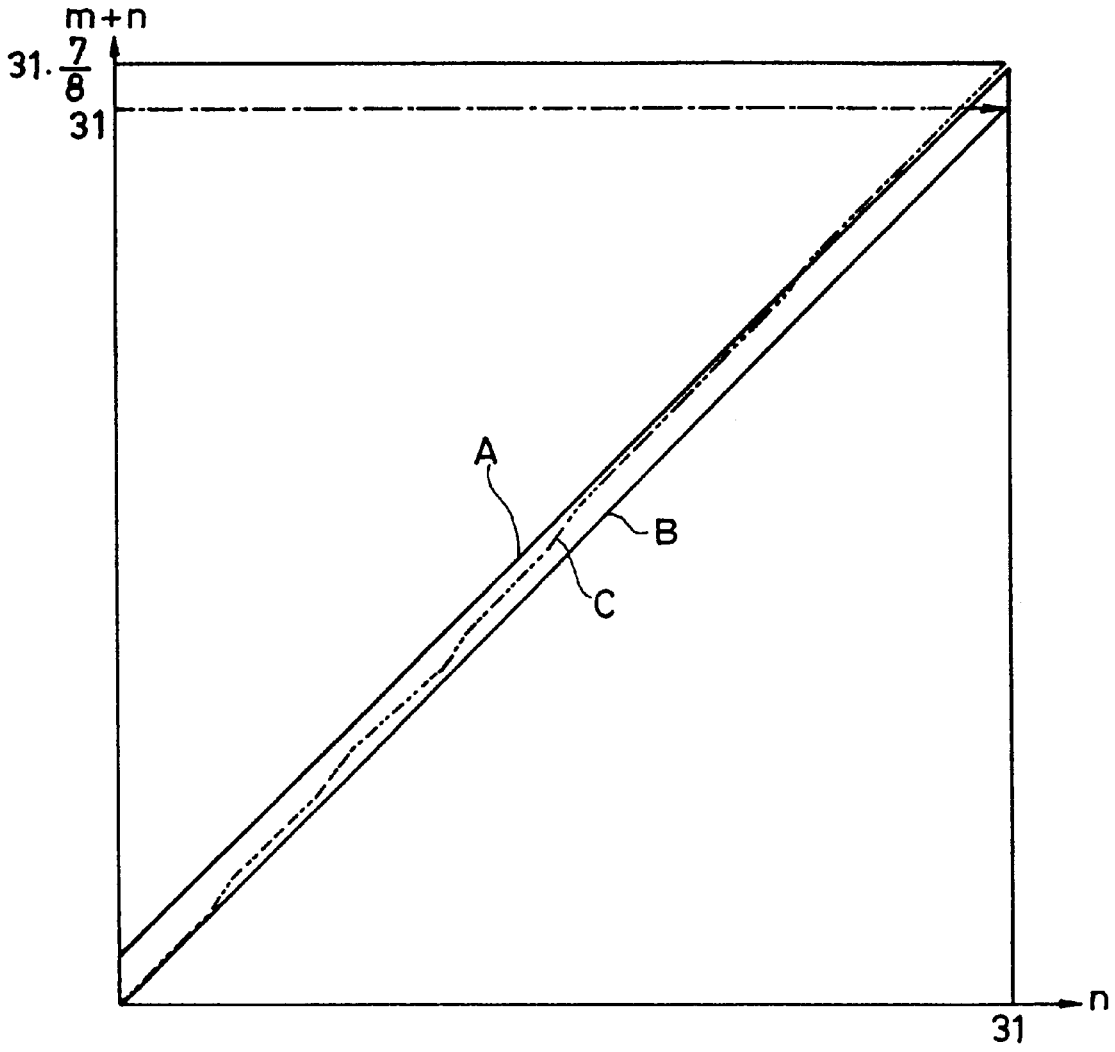
FIG. 5 is a graph of which the result of the bit expansion shown in FIG. 4 is plotted.

FIG. 5 shows a graph of which values in FIG. 4 are plotted. In FIG. 5, a value 31.7/8 on the vertical axis represents 31+ (7/8). Lines A and B in FIG. 5 correspond to the lines A and B of the related art reference shown in FIG. 2, respectively. In other words, the line A represents that "111" are used as expansion bits. The line B represents that "000" are used as expansion bits. In FIG. 5, a line C is plotted corresponding to values shown in FIG. 4. Thus, according to the embodiment, since the values of expansion bits vary corresponding to the values of original data, a bit expansion can be more smoothly performed.

Figure 6:
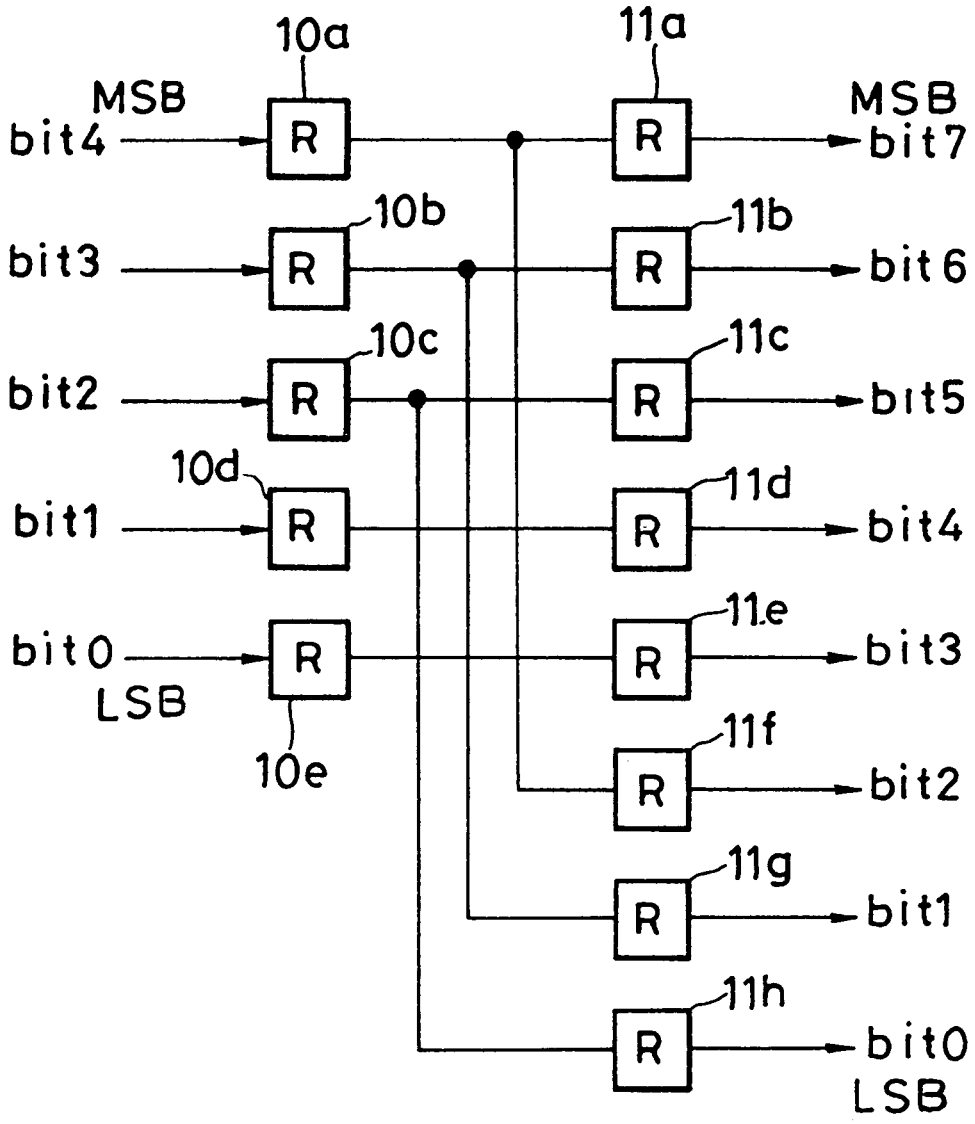
FIG. 6 is a block diagram showing an example of the structure for a bit expansion.

FIG. 6 shows an example of the structure for such a bit expansion in the case that m=5 and n=3. Individual bit values of original data of m bits are supplied to input registers 10*a* to 10*e*. In this example, the input registers 10*a* to 10*e* are assigned to MSB to LSB, respectively.

Output values of the input registers 10*a* to 10*e* are supplied to output registers 11*a* to 11*e*, respectively. In addition, the output values of the input registers 10*a*, 10*b*, and 10*c* are supplied to output registers 11*f*, 11*g*, and 11*h*, respectively. Output values of the output registers 11*a* to 11*h* are data of which a bit expansion has been performed. Output values of the output registers 11*a* to 11*h* are assigned to MSB to LSB, respectively.

The structure shown in FIG. 6 is only an example of the present invention. By changing connections of individual registers, a method for repeatedly assigning original data as expansion bits (see FIG. 3A) can be easily accomplished.

Likewise, the number of bits can be easily increased or decreased. For example, in the example of the above-described graphics data, to expand G (Green) data of six bits to data of eight bits, an input register 10*f* is disposed on the LSB side. An output value of the input register 10*f* is supplied to the output register 11*f*. In this case, the output value of the input register 10*c* is not supplied to the output register 11*c*.

The above-described embodiment was applied to graphics data. However, the present invention is not limited to such an embodiment. Instead, the present invention can be applied to other types of data such as audio data.

As described above, according to the present invention, the values of expansion bits vary corresponding to the values of original data. Thus, a bit expansion can be more smoothly performed.

In addition, according to the present invention, since a predetermined number of bits of original data are assigned to the low order side from the MSB side, a bit assignment can be smoothly performed in a simple structure.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A bit expander for adding n expansion bits to original data of m bits and expanding the original data of m bits to data of (m+n) bits, wherein a predetermined number of bits on the MSB side of the original data of m bits are added to the low order side of the original data.

2. The bit expander as set forth in claim 1, wherein in the case of m≦n, the bits of the original data are repeatedly added to the low order side of the original data.

3. The bit expander as set forth in claim 1, wherein in the case of m>n, the n bits on the MSB side of the original data are added to the low order side of the original data.

4. The bit expander as set forth in claim 1, wherein the original data is graphics data.

* * * * *